US007441313B2

(12) United States Patent
Degen

(10) Patent No.: US 7,441,313 B2
(45) **Date of Patent: *Oct. 28, 2008**

(54) SPRING CLAMP WITH HOOK

(75) Inventor: Klemens Degen, Weibern (DE)

(73) Assignee: Wolfcraft GmbH (DE)

( * ) Notice: Subject to any disclaimer, the term of this patent is extended or adjusted under 35 U.S.C. 154(b) by 61 days.

This patent is subject to a terminal disclaimer.

(21) Appl. No.: 10/792,008

(22) Filed: Mar. 3, 2004

(65) Prior Publication Data

US 2005/0193529 A1 Sep. 8, 2005

(51) Int. Cl.
*A44B 21/00* (2006.01)

(52) U.S. Cl. ..... 24/512; 24/500; 24/502

(58) Field of Classification Search ..... 24/67.3, 24/67.5, 67.7, 67.9, 67 R, 489, 343–349, 24/498–508, 513, 565, 517–520, 570, 576; 100/234; 81/304, 318, 321, 342, 393, 486, 81/427, 427.5; 269/3, 6, 95; 29/268, 270, 29/276, 278; D8/72; 294/3, 16
See application file for complete search history.

(56) References Cited

U.S. PATENT DOCUMENTS

| | | | | | |
|---|---|---|---|---|---|
| 1,468,884 | A | | 9/1923 | Schneider | 24/501 |
| 1,792,837 | A | * | 2/1931 | Harrison | 81/419 |
| D138,285 | S | * | 7/1944 | Schneiderwind | D8/72 |
| 2,685,679 | A | * | 8/1954 | Sam | 24/545 |
| D191,108 | S | * | 8/1961 | Dahlen | D32/64 |
| 3,654,755 | A | * | 4/1972 | Bell | 81/302 |
| 4,106,374 | A | * | 8/1978 | Dragan | 81/302 |
| 4,809,399 | A | * | 3/1989 | Hersker | 269/6 |
| 4,834,352 | A | * | 5/1989 | Thornton | 269/6 |
| 4,907,477 | A | * | 3/1990 | Farber | 81/302 |
| 4,934,222 | A | * | 6/1990 | Rittmann et al. | 81/427.5 |
| D373,294 | S | * | 9/1996 | Eggert et al. | D8/52 |
| 5,791,210 | A | * | 8/1998 | Wolff et al. | 81/302 |
| 5,876,026 | A | * | 3/1999 | Chen | 269/156 |
| 6,185,795 | B1 | * | 2/2001 | Shui-Shang | 24/507 |
| 6,389,625 | B1 | * | 5/2002 | Rivera | 7/128 |
| 6,470,522 | B2 | * | 10/2002 | Veltz et al. | 81/427.5 |
| D514,914 | S | * | 2/2006 | Degen | D8/72 |
| D515,386 | S | * | 2/2006 | Noniewicz et al. | D8/72 |

FOREIGN PATENT DOCUMENTS

| | | |
|---|---|---|
| DE | 200 01 498 U1 | 7/2001 |
| FR | 1 325 394 | 12/1963 |

* cited by examiner

*Primary Examiner*—Robert J Sandy
*Assistant Examiner*—Ruth C Rodriguez
(74) *Attorney, Agent, or Firm*—Bell, Boyd & Lloyd LLP

(57) ABSTRACT

A spring clamp has a clamping mouth (1) with two clamping jaws (2) which can be spring-loaded toward one another by the force of a spring. The clamping jaws (2) are formed by arms (3) which are connected to one another in an articulated manner at one end. The other ends of the arms (3) which form actuating sections (4) can be moved toward one another in order to open the clamping mouth (1). The two abutting clamping jaws (2) together with the articulation pin (5) of the arms (3) define a reference plane (E). An angle bisector (G) between the two actuating sections (4) is inclined at approximately 90° to the reference plane (E). A hook may be provided at the actuating section (4).

11 Claims, 6 Drawing Sheets

SPRING CLAMP WITH HOOK

BACKGROUND OF THE INVENTION

The present invention generally pertains to spring clamps. In an embodiment, the present invention relates to a spring clamp having a clamping mouth with two clamping jaws which are spring-loaded toward one another by the force of a spring. The clamping jaws are formed by arms which are connected to one another in an articulated manner at one end, and the other ends of which form actuating sections which can be moved toward one another in order to open the clamping mouth. The two abutting clamping jaws, together with the articulation pin of the arms, define a reference plane. A hook may be arranged at the free end of an actuating section.

A spring clamp without a hook is described in DE 200 01 498 U1.

Spring clamps with hooks are described in U.S. Pat. No. 1,468,884 and FR 1 325 394. In those documents, the hook can be used to suspend the spring clamp with hook, so that the clamping mouth of the spring clamp projects downward in order for something to be clamped firmly thereon. The spring clamps described in those documents are also suitable, in principle, for being fastened somewhere by way of the clamping mouth, so that something can be hung on the hook. This functions, however, only in a horizontal position of the reference plane formed by the two abutting clamping jaws together with the articulation pin of the arms.

SUMMARY OF THE INVENTION

One advantage of the present invention is to provide new spring clamps.

Another advantage of the present invention is to provide a spring clamp with hook in a functionally advantageous manner.

In an embodiment of the present invention, the angle bisector between the two actuating sections is inclined at approximately 90° to the reference plane described herein. This allows more ergonomic handling.

The spring clamp may be further provided with a hook mounted such that it can be pivoted about an axis arranged at the end of the actuating section. It is possible for the hook to be pivotable about an axis located substantially parallel to the reference plane. It may be advantageous if the hook is arranged in a releasable manner on the actuating arm. One preferred connection of the hook to the clamp is a bayonet connection which allows the hook to be removed, and refitted, in a material-preserving manner. The spring clamp according to the present invention may be used without hooks. Also, it is possible for hooks of different sizes or shapes to be combined with the spring clamp.

A further advantage can be providing the hook, when pivoted in, to be located in a parallel position in relation to the actuating section. In a pivoted-out position, the hook can extend in the imaginary line of extension of the actuating section carrying the hook.

The two actuating sections of the arms form grip zones, which are oriented away from one another and may be covered with a soft-plastics material. The mutually facing inner sides of the actuating sections can assume a parallel position in relation to one another when the spring clamp is open.

The hook, when pivoted in, is preferably located in a pivot-in space which is arranged at the inner side of the actuating section carrying the hook. The hook may be open. It is also possible, however, for the hook to be closed, or to be capable of being closed, for example, by a closure in the manner of a snap hook. A closure tongue which is urged by a spring into the closed position can be provided for this purpose. The closure tongue may have a curvature which can be oriented in the direction of the inside of the hook.

A journal may be used with mounting the hook to the clamp. The journal may project from the end of the inner side of the actuating section carrying the journal, and an end surface of the journal may form a stop against which, in the open position, a mating stop of the other actuating section contacts.

In an embodiment, the angle bisector between the two actuating sections, this angle bisector running through the articulation pin, may be located approximately perpendicularly to the reference plane. The spring clamp can then be used in the manner of a pistol grip.

The hook may be arranged on the actuating section which is located or positioned in the flat of the hand of the person actuating the spring clamp with hook. The actuating section which is located opposite the latter actuating section is rooted in the region of the clamping mouth. This actuating section is grasped by the fingers of the user. The soft-plastics grip zone which is positioned in the flat of the user's hand can be longer than the soft zone which is grasped by the user's fingers.

The hook can be provided to pivot through 360° about its bearing journal. The hook may also be pivotable about an axis which runs perpendicularly to the axis for pivoting 360°. According to a further variant of the present invention, it is provided that the axis of rotation about which the hook is arranged in a rotatable manner on one of the arms runs parallel to the reference plane. An axial extension of the hook may be mounted by a retaining bracket which is arranged on the inner side of one arm. As a result, the axis of rotation of the hook is located almost in the reference plane. The axial extension of the hook can be snapped into a bearing recess of the retaining bracket. For this purpose, the retaining bracket has a snap-action opening, through which the neck of the axial extension penetrates.

Additional features and advantages of the present invention are described in, and will be apparent from, the following Detailed Description of the Invention and the figures. The features and advantages may be desired, but, are not necessarily required to practice the present invention.

BRIEF DESCRIPTION OF THE FIGURES

Exemplary embodiments of the invention will be further explained below with reference to attached drawings.

FIG. 4 shows a rear view of the exemplary embodiment according to FIG. 1 with the hook pivoted in.

DETAILED DESCRIPTION OF THE INVENTION

Figure 1:
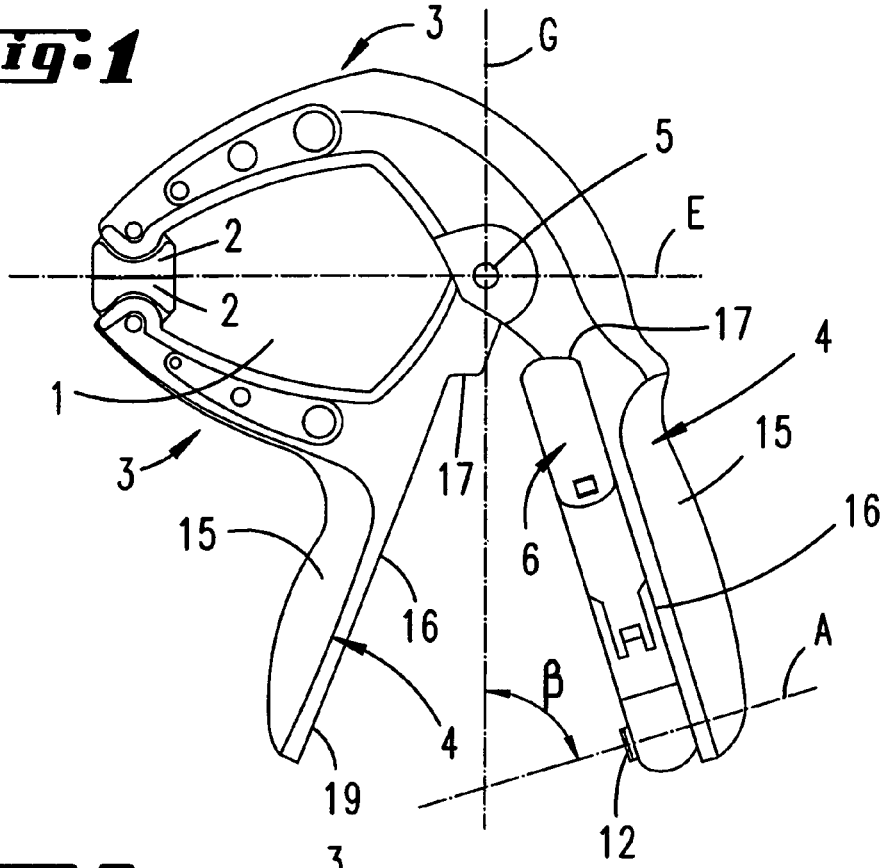
FIG. 1 shows a first exemplary embodiment of the invention in elevation.

One example of the present invention is shown in FIGS. 1-5 which shows a spring clamp. The clamp has a clamping mouth 1. The clamping mouth 1 is formed by two curved clamping sections, in which each clamping section is formed by an arm 3. One end of the clamping section carries, in each case, a clamping jaw 2. The clamping jaws 2 are pressed against one another by means of a spring (not illustrated). The other ends of the clamping sections meet in the region of an articulation pin 5, about which the two arms 3 can be pivoted when the two actuating sections 4 are moved toward one another. The clamping mouth 1 then opens.

The two clamping jaws 2 clamped against one another form, together with the articulation pin 5, a reference plane E.

The end of one arm 3 carries a U-shaped hook 6. The two arms 3 may each be produced as an injection molding, with a holder for the hook 6 being molded on one arm 3. The hook 6 may likewise be produced as an injection molding. In the case of the exemplary embodiment illustrated in FIGS. 1 to 5, the angle bisector G between the two actuating sections 4, which can be gripped by the actuator's hand, runs approximately transversely to the reference plane E, which is defined by the separation plane of the two clamping jaws 2 located one upon the other and also by the articulation pin 5. The angle bisector G thus runs at a right angle to the reference plane E. For this purpose, the arm 3 which has the actuating section 4 located in the flat of the user's hand is curved. The arm 3 which has its actuating section 4 grasped by the actuator's fingers, in contrast, is Y-shaped. The grip zone 15, formed by a soft-plastics layer, of the Y-shaped arm 3 is shorter than the grip zone 15 of the curved arm 3.

The two mutually facing inner sides 16 of the two actuating sections 4 form a pivot-in space 17 for the hook 6. The hook 6 can be pivoted about a journal 12 disposed at the free end of the actuating section 4 of the curved arm 3.

Figure 2:
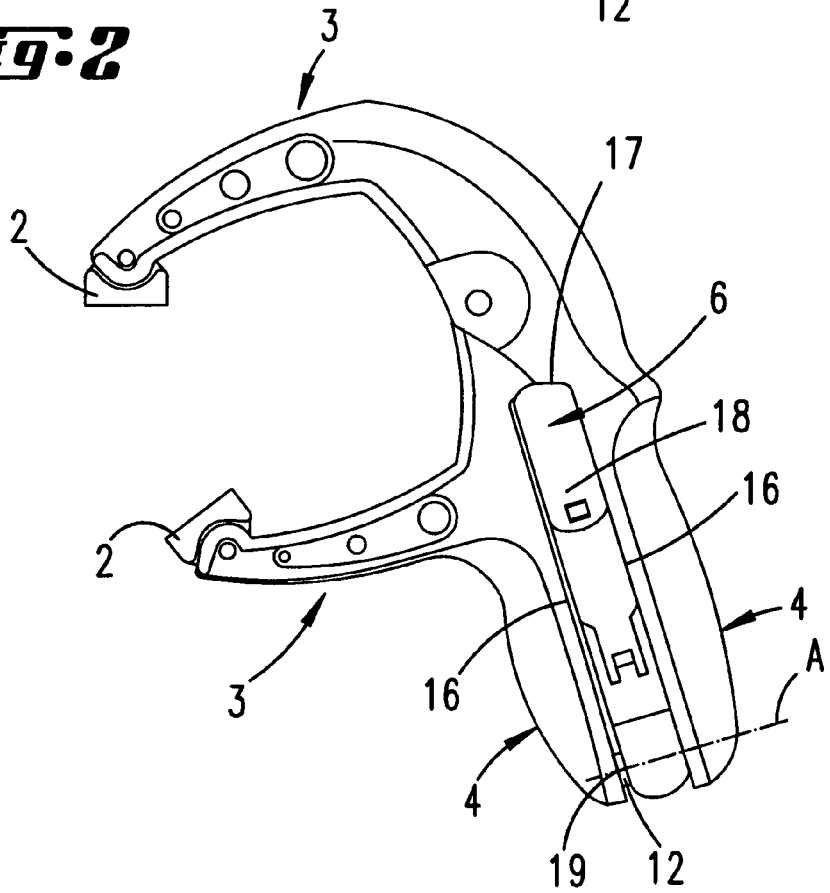
FIG. 2 shows the exemplary embodiment according to FIG. 1 in an open position.
Figure 3:
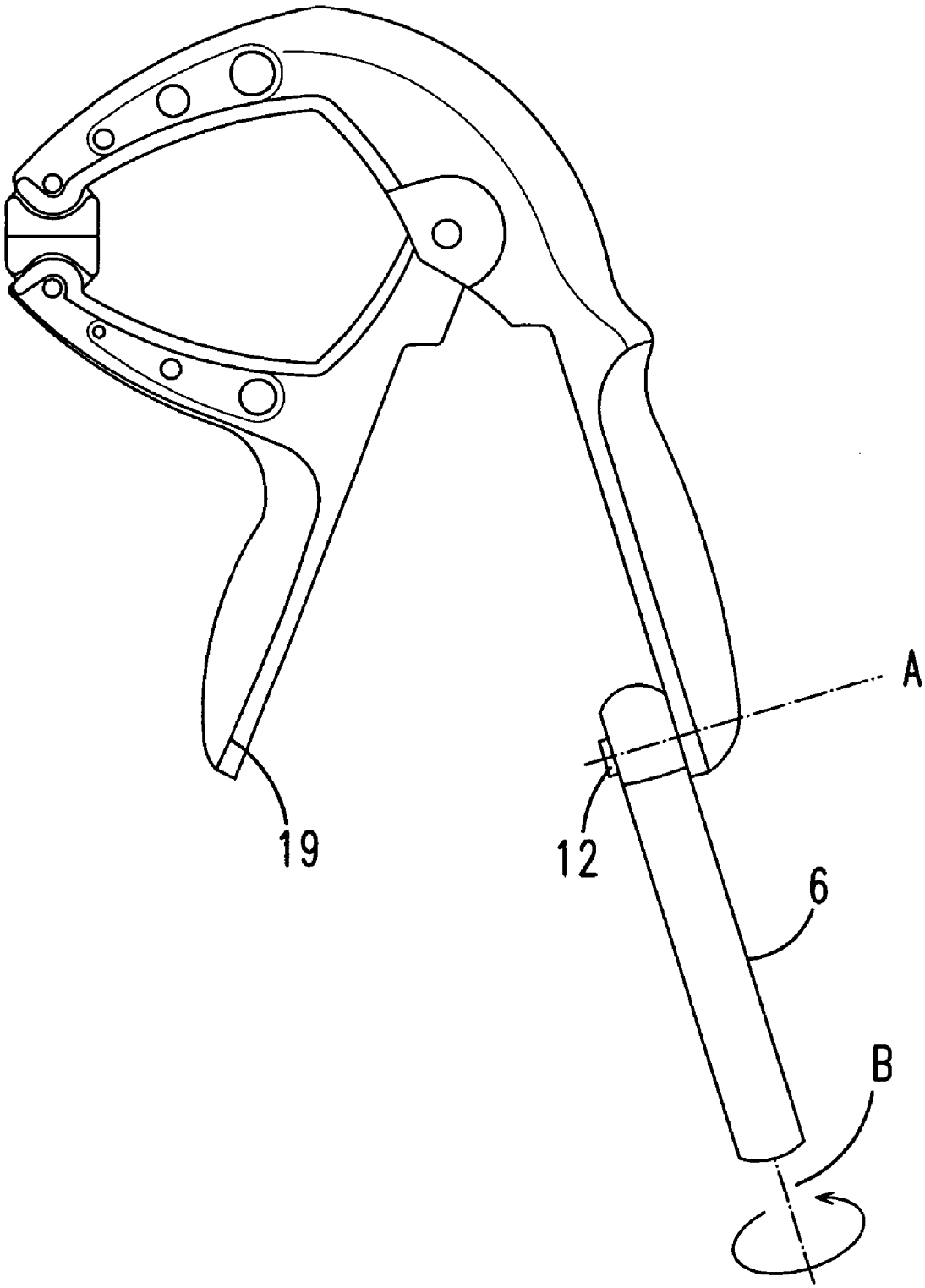
FIG. 3 shows the exemplary embodiment according to FIG. 1 with the hook pivoted out.

Referring to FIGS. 1-3, a pivot axis A, which is defined by the journal 12, runs at an angle β of approximately 70° in relation to the angle bisector G. The pivot axis A is located perpendicularly to the inner side 16 of the actuating section 4 which carries the journal 12. In the pivot-out position, the hook 6 thus forms a 180° extension of the actuating section 4 (see FIG. 3).

Figure 4:
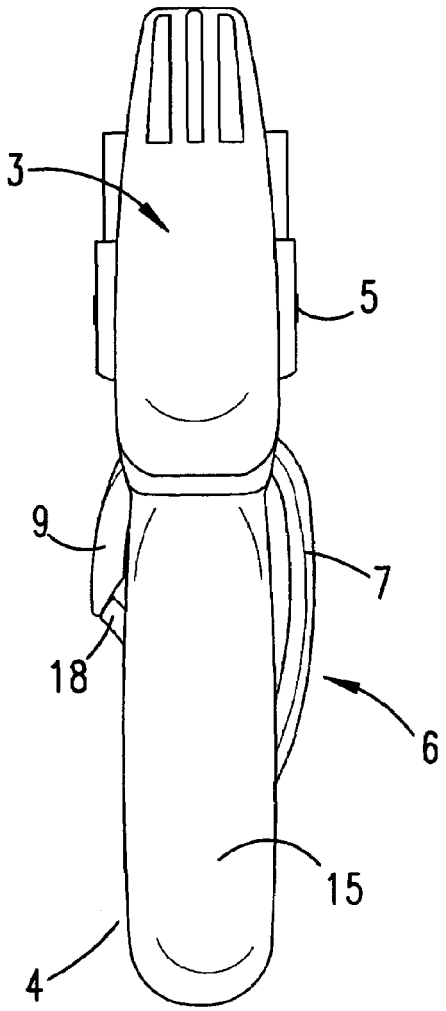
Figure 5:
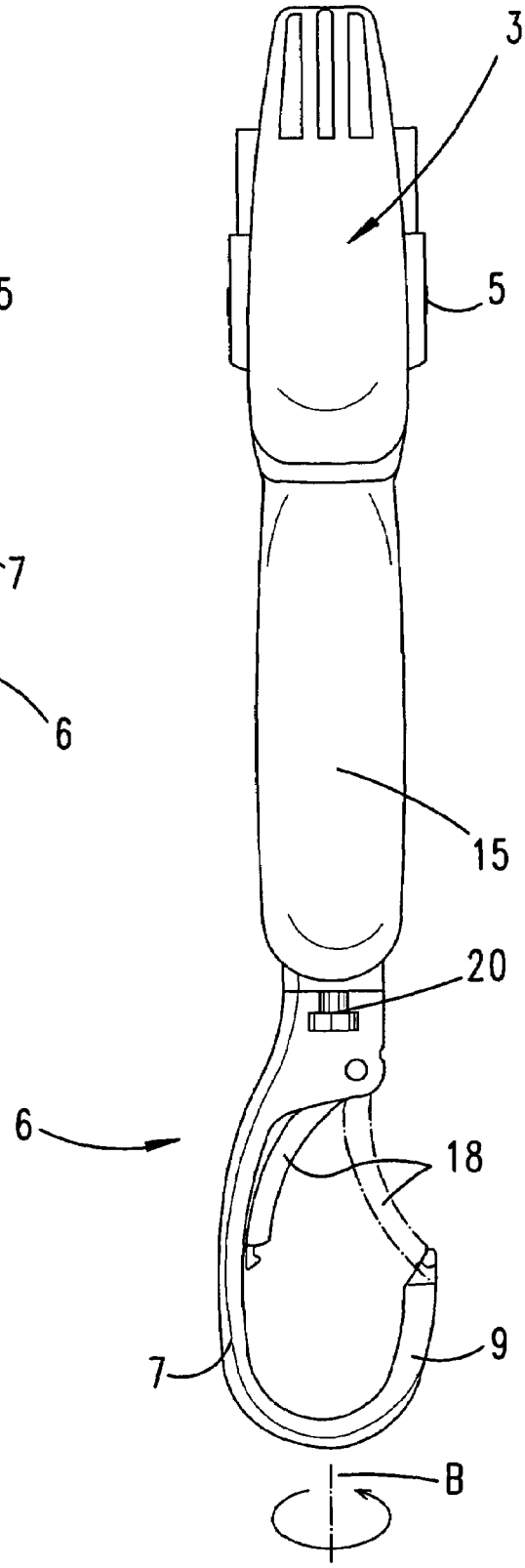
FIG. 5 shows an illustration according to FIG. 4 with a modified hook pivoted out.

As can be seen from FIGS. 4 and 5, the width of the U-shaped hook 16 is greater than the width of the grip zone 15.

Referring to FIG. 5, the hook 6 can be pivoted about a pivot pin 20. The pivot axis B defined by the latter is located perpendicularly to the pivot axis A, which is defined by the journal 12.

The hook 6 has two legs 7, 9 forming a U-shape. The leg 7 of the U-shape is configured to be longer than the leg 9 of the U-shape, and the resulting hook opening can be closed by means of a closure tongue 18. The closure tongue 18 is resiliently mounted in the direction of its closed position and thus forms a carabine-hook closure. The closure tongue 18, furthermore, is curved towards the inside of the hook 6. The closure tongue 18, in addition, has an end hook by means of which it enters into an opening of the leg 9 of the U-shape.

The particular arrangement of the two actuating sections 4 with the clamping mouth 1 of the exemplary embodiment illustrated in FIGS. 1-6 provides the spring clamp with a novel method of actuation. The spring clamp can be held in the manner of a pistol grip and actuated.

The arms 3 have a U-shaped cross-sectional profile and consist of plastics material. The hook 6 also consists of plastics material.

Figure 6:
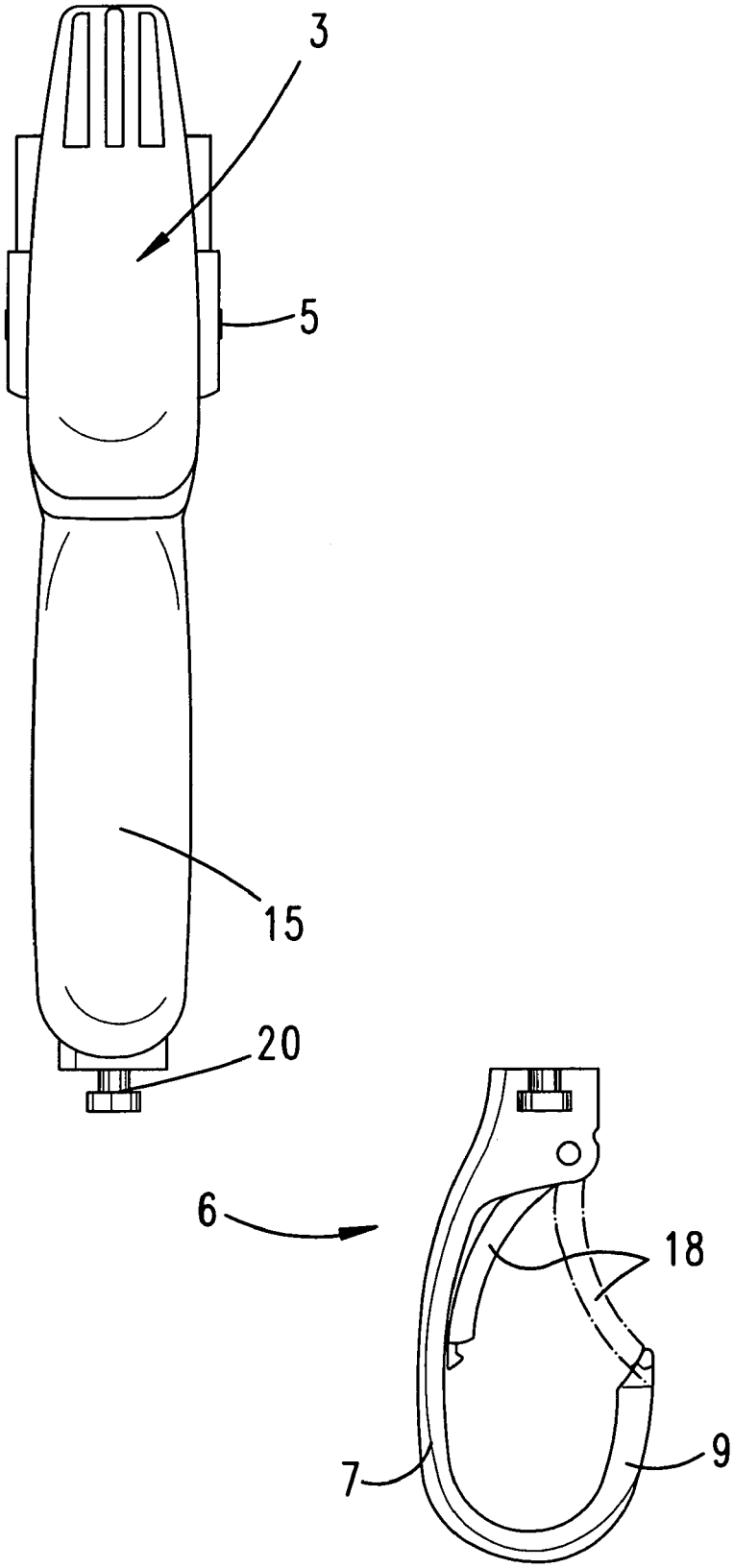
FIG. 6 shows an illustration according to FIG. 4 with the hook removed.
Figure 7:
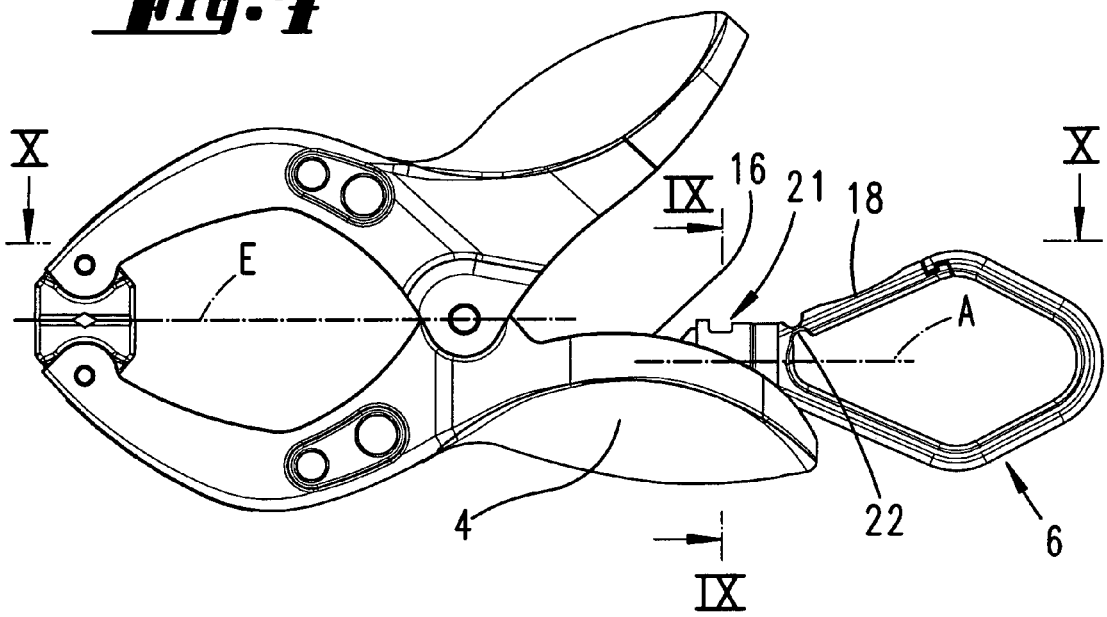
FIG. 7 shows a further exemplary embodiment of the invention in elevation.
Figure 8:
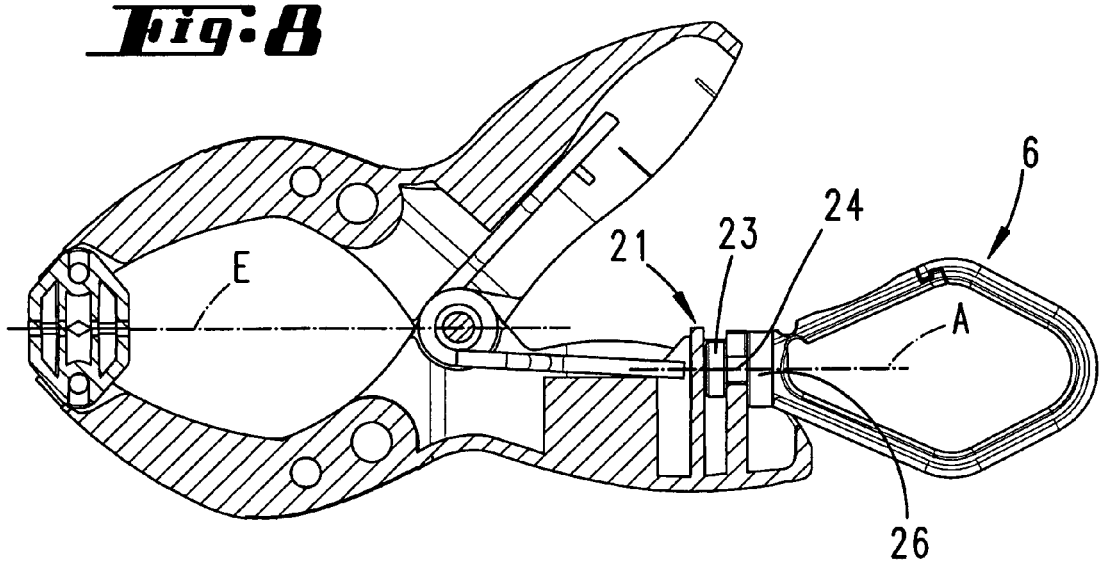
FIG. 8 shows a cross section through the exemplary embodiment according to FIG. 7.
Figure 10:
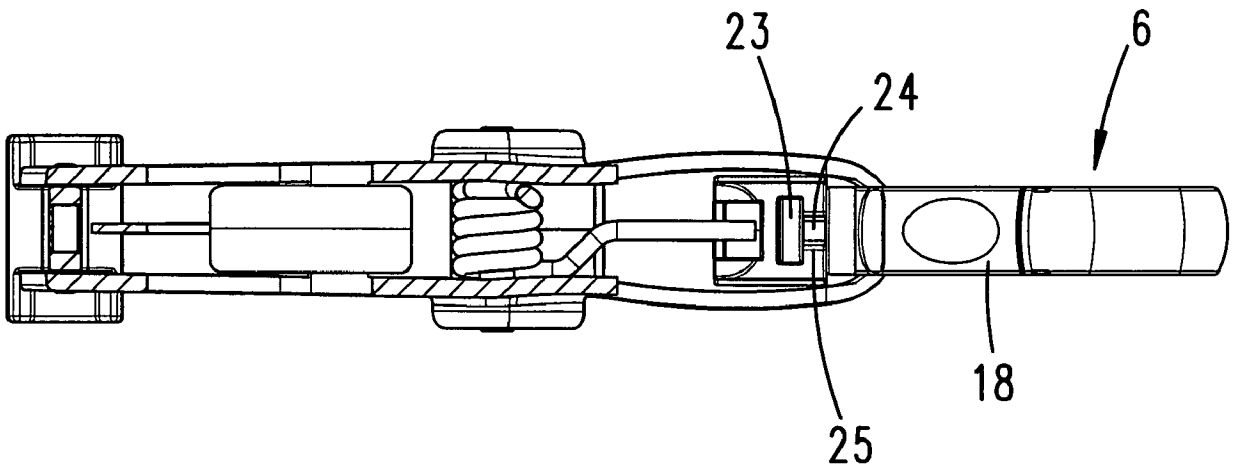
FIG. 10 shows a section along line X-X in FIG. 7.
Figure 9:
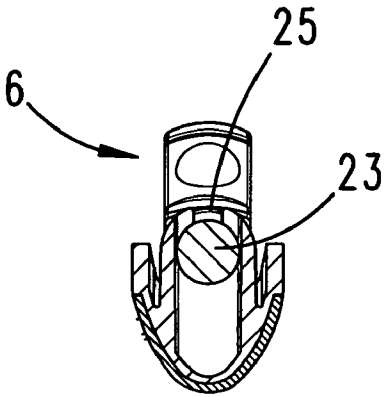
FIG. 9 shows a section along line IX-IX in FIG. 7.

As can be gathered from FIG. 6, the hook 6 can be separated from the clamp. The clamp is connected to the hook 6 via a mushroom-shaped pin 20, which can be clipped into a corresponding pocket of the hook 6.

Another exemplary embodiment of the present invention is illustrated in FIGS. 7-10. The hook 6 likewise has an opening which is closed by a tongue 18. The tongue 18 is integrally formed with the material of the hook 6 and forms a film hinge 22. The hook 6 has an axial extension with a round section 26, which is followed by a neck 24 of reduced cross-section, on which a circular-disk end section 23 is seated.

The axial extension is mounted in a retaining bracket 21 of an actuating section 4 of one arm 3. The retaining bracket 21 is located in the region of the inner side 16 of the actuating section 4, that is to say between the two arms. The arrangement of the axial extension at the retaining bracket 21 is achieved in the manner of a snap-action connection. For this purpose, the retaining bracket 21 has a snap-action opening 25, through which the neck 24 can be snapped in. The positively locking axial securing action takes place with the aid of the circular end section 23 and of the round section 26. In the case of this exemplary embodiment, the axis of rotation of the hook 6 runs parallel to the connecting line E.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A spring clamp, comprising a clamping mouth with two clamping jaws spring-loaded toward one another by a spring and are formed by first and second arms which are connected to one another in an articulated manner at one end, and other ends of which form actuating sections which can be moved toward one another in order to open the clamping mouth; when the two clamping jaws are abutted together, the two clamping jaws, together with the articulation pin of the first and second arms, define a reference plane; wherein an angle bisector between the two actuating sections that passes through the articulation pin is inclined at 90° to the reference plane;

wherein the one arm of the first and second arms is substantially Y-shaped and the other arm of the first and second arms is substantially L-shaped.

2. The spring clamp according to claim 1, further comprising a hook pivotally mounted to one of the actuating sections.

3. The spring clamp according to claim 2, wherein the hook, when pivoted in, is located in a substantially parallel position in relation to the actuating section.

4. The spring clamp according to claim 2, wherein the hook has a closure tongue.

5. The spring clamp according to claim 4, wherein the closure tongue is urged by spring force into a closed position and is curved in a direction of an inside of the hook.

6. A clamp, comprising:

first and second clamping jaws biased toward each other;

a first actuating section connected to the first clamping jaw;

a second actuating section connected to the second clamping jaw;

the first and second clamping jaws extending in a first reference direction during use of the first and second clamping jaws, and the first and second actuating sections extending in a second reference direction during use of the first and second clamping jaws which is generally perpendicular to the first reference direction;

a hook pivotally mounted to one of the first and second actuating sections;

wherein the hook has a pivoted-in position between inner sides of the actuating sections; and a first arm connected to the first clamping jaw and a second arm connected to the second clamping jaw, the first and second arms pivotally connected together at an arm pivot axis, wherein the hook has a pivot axis that is perpendicular to the arm pivot axis.

7. A spring clamp, comprising a clamping mouth with two clamping jaws spring-loaded toward one another by a spring and are formed by first and second arms which are connected to one another in an articulated manner at one end, and other ends of which form actuating sections which can be moved toward one another in order to open the clamping mouth; when the two clamping jaws are abutted together, the two clamping jaws, together with an articulation pin of the first and second arms, define a reference plane; wherein an angle bisector between the two actuating sections is inclined at substantially 90° to the reference plane;

a hook pivotally mounted to one of the actuating sections; and a retaining bracket located on an inner side of one actuating section, the retaining bracket providing rotary articulation of the hook.

8. A spring clamp, comprising:

a clamping mouth with two clamping jaws spring-loaded toward one another by a spring and are formed by first and second arms which are connected to one another in an articulated manner at one end, and other ends of which form actuating sections which can be moved toward one another in order to open the clamping mouth; when the two clamping jaws are abutted together, the two clamping jaws, together with the articulation pin of the first and second arms, define a reference plane; wherein an angle bisector between the two actuating sections is inclined at 90° to the reference plane; wherein the one arm of the first and second arms is substantially Y-shaped and the other arm of the first and second arms is substantially L-shaped; and a hook pivotally mounted to one of the actuating sections; wherein the two actuating sections have grip zones oriented away from one another and having a soft grip layer, and inner sides oriented toward one another; and wherein the hook, when pivoted in, being positioned in a pivot-in space of at least one of the inner sides.

9. A spring clamp, comprising:

a clamping mouth with two clamping jaws spring-loaded toward one another by a spring and are formed by first and second arms which are connected to one another in an articulated manner at one end, and other ends of which form actuating sections which can be moved toward one another in order to open the clamping mouth; when the two clamping jaws are abutted together, the two clamping jaws, together with the articulation pin of the first and second arms, define a reference plane; wherein an angle bisector between the two actuating sections is inclined at 90° to the reference plane; wherein the one arm of the first and second arms is substantially Y-shaped and the other arm of the first and second arms is substantially L-shaped;

a hook pivotally mounted to one of the actuating sections; and a journal mounting the hook to one of the actuating sections, the journal having stop against which a mating stop of the other actuating section contacts when the spring clamp is in an open position.

10. A spring clamp, comprising:

a clamping mouth with two clamping jaws spring-loaded toward one another by a spring and are formed by first and second arms which are connected to one another in an articulated manner at one end, and other ends of which form actuating sections which can be moved toward one another in order to open the clamping mouth; when the two clamping jaws are abutted together, the two clamping jaws, together with the articulation pin of the first and second arms, define a reference plane; wherein an angle bisector between the two actuating sections is inclined at 90° to the reference plane; wherein the one arm of the first and second arms is substantially Y-shaped and the other arm of the first and second arms is substantially L-shaped;

a hook pivotally mounted to one of the actuating sections; and a retaining bracket located on an inner side of one actuating section, the retaining bracket providing rotary articulation of the hook.

11. The spring clamp according to claim 10, wherein the retaining bracket has a snap-action opening, and the hook has a neck latched to the retaining bracket through the a snap-action opening.

* * * * *